United States Patent [19]

Propst et al.

[11] 4,368,675

[45] Jan. 18, 1983

[54] STACKING PALLET

[75] Inventors: Robert L. Propst, Ann Arbor; Terry L. Mitchell, Jenison, both of Mich.

[73] Assignee: Herman Miller, Inc., Zeeland, Mich.

[21] Appl. No.: 142,346

[22] Filed: Apr. 21, 1980

Related U.S. Application Data

[63] Continuation of Ser. No. 960,173, Nov. 13, 1978, abandoned.

[51] Int. Cl.[3] ..... B65D 19/00; B65D 19/44

[52] U.S. Cl. ..... 108/53.1; 108/55.1; 211/187; 211/194

[58] Field of Search ..... 108/53.5, 55.1–55.5, 108/51.1, 57.1, 53.1, 53.3, 108; 211/194, 188, 187, 190; 206/509, 511, 512, 386

[56] References Cited

U.S. PATENT DOCUMENTS

| | | | |
|---|---|---|---|
| 2,922,530 | 1/1960 | Skeppstedt | 108/53.5 |
| 2,941,772 | 6/1960 | Thayer | 108/53.1 |
| 3,272,345 | 9/1966 | Wallace | 211/187 X |
| 3,506,138 | 4/1970 | Travis | 108/53.5 X |
| 3,563,626 | 2/1971 | Ferdinand et al. | 108/108 X |
| 3,993,002 | 11/1976 | Stroh | 108/108 |
| 4,052,084 | 10/1977 | Propst | 108/55.1 X |

FOREIGN PATENT DOCUMENTS

| | | | |
|---|---|---|---|
| 7014316 | 4/1971 | Netherlands | 108/53.5 |
| 790794 | 2/1958 | United Kingdom | 211/194 |

*Primary Examiner*—William E. Lyddane

*Attorney, Agent, or Firm*—Olsen and Stephenson

[57] ABSTRACT

A material handling pallet comprising a rectangular base having downwardly-extending support legs and an upright frame mounted on the base for supporting objects on the pallet. The frame consists of a pair of open framework end portions positioned at opposite ends of the base and a cross frame portion extending lengthwise of the pallet between and connected to the end portions. Vertically-spaced horizontal load-supporting members are mounted on the cross frame portion for supporting objects which are removable therefrom either by movement lengthwise of the pallet through the end portions or sideways of the pallet. The frame terminates at its upper end in frame members which extend transversely of the base and which are positioned in substantial vertical alignment with the supporting legs enabling the pallet to be stacked on another like pallet. Projecting members are mounted on the frame members and recesses are formed in the supporting legs so that when one pallet is stacked upon another like pallet, the supporting legs of the upper pallet receive the projecting members of the lower pallet to prevent relative horizontal movement between the stacked pallets.

14 Claims, 8 Drawing Figures

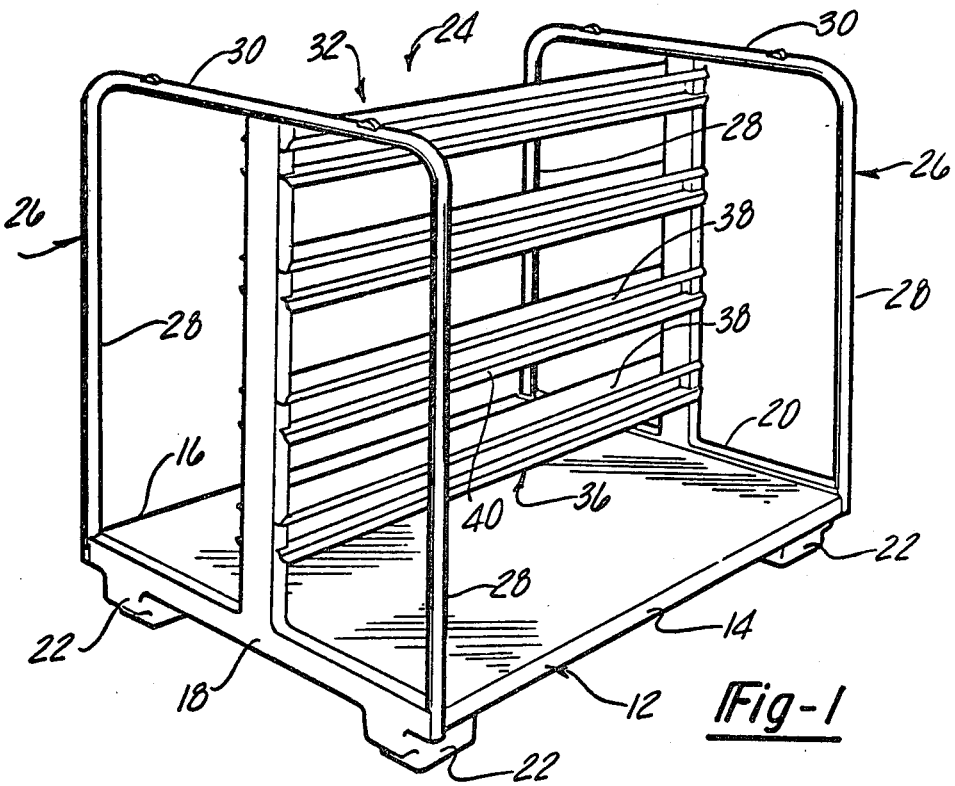
Fig-1
Fig-2
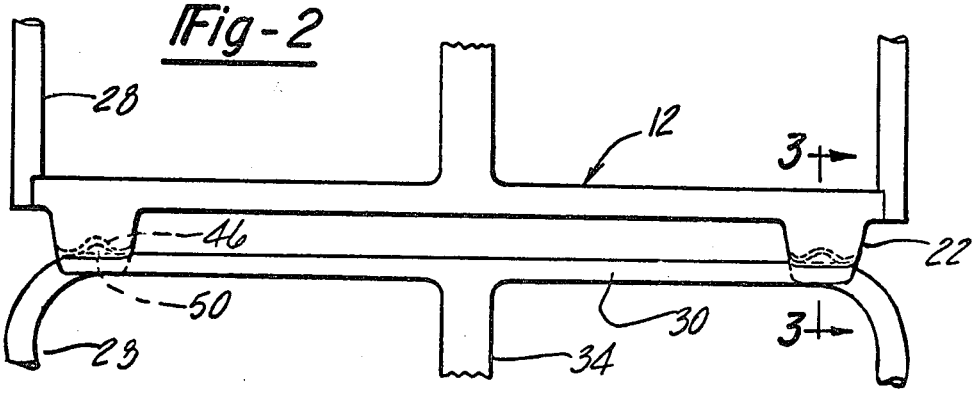
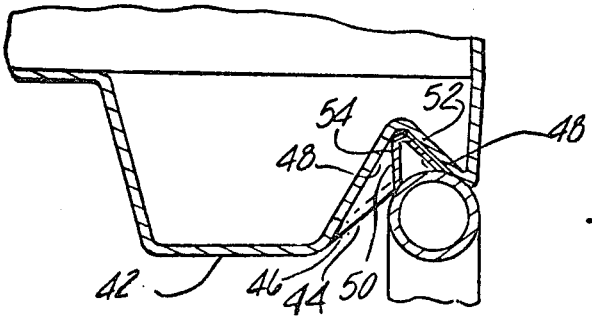
Fig-3

STACKING PALLET

REFERENCE TO PENDING APPLICATION

This application is a continuation of pending application Ser. No. 960,173, filed Nov. 13, 1978, now abandoned.

BACKGROUND OF THE INVENTION

The present invention relates to an improved material handling pallet.

In most material handling systems, pallets are employed for transporting parts, raw materials, and equipment. Yet, not enough effort has been devoted in designing a pallet adaptable to carry an assortment of objects of different sizes and shapes. The conventional platform-type pallet is still widely used even though it is not versatile, being suited only to carry objects which can be easily stacked one on another. Storage bins can handle small parts. However, if both large and small parts are mixed together, time is wasted in sorting the parts; and the larger parts may damage the smaller parts. Manufacturers who use a variety of small parts as components in larger systems would realize savings in material handling costs and material damage if a pallet meeting the above-listed functional objectives was available. In manufacturing concerns which assemble many small parts and sub-assemblies together into a larger unit, advantageous use of such pallets can be made. For example, electronic devices usually consist of a large number of electronic sub-assemblies installed within a larger cabinet. Such cabinets can be large and awkward to handle, and unnecessary handling increases the likelihood of damaging the cabinet or its components. Leaving the cabinet frame on a pallet which easily can be moved between and within work areas would facilitate the manufacturing process and reduce costs. Of course, the pallet need be constructed so that the objects carried on the pallet are accessible from all sides. Also, the pallet should be constructed so that like pallets can be stacked to make use of the air space in the storage area.

It is the object of this invention, therefore, to provide an improved pallet to which access can be gained from all sides. It is another object of the present invention to provide a pallet capable of being stacked on another like pallet and having means to restrain relative horizontal movement between stacked pallets. It is another object of the present invention to provide a pallet having an open framework construction which supports parts or the like and which offers bracing support for the objects carried on the pallet.

SUMMARY OF THE INVENTION

In accordance with the present invention, an improved material handling pallet is provided consisting of a rectangular base having sides and ends and a plurality of corner supporting legs connected to and extending downwardly from the base. The corner legs provide a clearance below the pallet for receiving the tines of a forklift truck or similar pallet-lifting apparatus facilitating movement of the pallet between locations. An upright frame is mounted on the base and includes a pair of open framework end portions positioned at opposite ends of the pallet and a cross frame portion extending lengthwise of the pallet between and connected to the end portions. In one embodiment, vertically-spaced shelves are detachably mounted on the cross frame portion for supporting items such as parts and equipment. In another embodiment, vertically-spaced horizontal rails are mounted on the cross frame portion for slideably supporting containers which in turn carry small parts. The parts which are carried by the horizontal load-supporting members can be removed either by lengthwise movement of the base through the end frame portions or by sideways movement across the pallet.

The upright frame terminates at its upper end in transversely-extending frame members which are in general vertical alignment with the supporting legs. This vertical alignment enables one pallet to be stacked upon another pallet with the supporting legs on the upper pallet engaging the transversely-extending frame members on the lower adjacent pallet.

Locating means including projecting members mounted on the transversely-extending frame members and recesses formed in the supporting legs serves to restrain relative horizontal movement between a pair of stacked pallets. Each projecting member on the frame of a subjacent pallet is received by a recess in an associated supporting leg on the upper adjacent pallet and cooperates therewith to effectively restrain undesirable relative horizontal movement between the pallets.

Further objects, features, and advantages of the present invention will become apparent from a consideration of the following description when taken in connection with the appended claims and the accompanying drawing in which:

FIG. 1 is a perspective view of the material handling pallet of the invention;

FIG. 2 is a fragmentary side elevational view showing the bottom portion of a pallet like the pallet shown in FIG. 1 supported on another like pallet;

FIG. 3 is a sectional view taken substantially from line 3—3 in FIG. 2;

Figures 4, 5, 6, 7, 8:
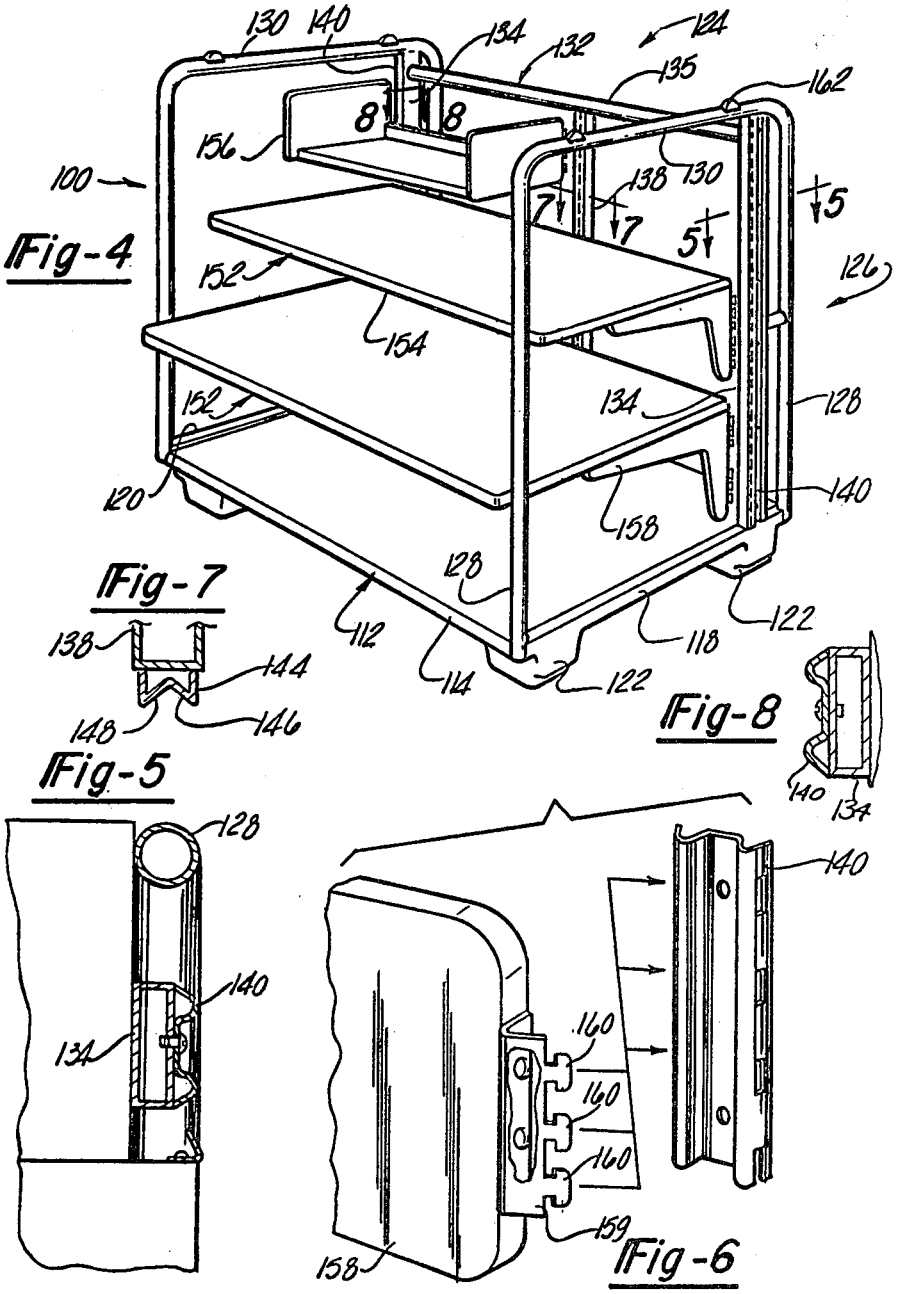
FIG. 4 is a perspective view of a modified form of the material handling pallet of the present invention.
FIG. 5 is a fragmentary sectional view of the pallet of the present invention taken substantially from line 5—5 in FIG. 4.
FIG. 6 is a fragmentary exploded view showing a hanging strip and a mounting bracket on a load-supporting member shown in FIG. 4.
FIG. 7 is a fragmentary sectional view of the central upright strut in the pallet shown in FIG. 4 and taken substantially from line 7—7 therein.
FIG. 8 is a fragmentary sectional view taken substantially from line 8—8 in FIG. 4.

Referring to the drawing, the material handling pallet of this invention, indicated generally at 10, is shown in FIG. 1 consisting of a generally rectangular base 12 having sides 14 and 16 and ends 18 and 20 and forming a low platform on which materials can be placed. Downwardly-extending legs 22 are connected to the base 12 at each corner and provide a clearance below the base 12 enabling the tines of a forklift truck or other pallet-lifting means to engage the underside of the base 12 allowing the pallet 10 to be lifted and transported from one place to another. Provision of only corner legs 22 enables the forklift truck to pick up the pallet 10 from both the sides or ends of the pallet 10 facilitating its movement. The base 12, as shown in this embodiment, is formed of metal, but it is also contemplated that the base 12 can be formed of other materials such as plastics which are suitably strong.

An upright frame 24 is mounted on the base 12 and includes a pair of open framework end portions 26 positioned at the ends 18 and 20 of the base 12. Each open framework end portion 26 includes upright end members 28, each of which is located at a corner of the base 12. A generally horizontal top member 30 forms an upper frame member that extends transversely of the base 12. The horizontal top member is integrally formed with the upright end members 28 at their upper ends, although a separate top member 30 can be assembled and connected to the upright members 28.

An open framework cross frame portion 32 extends between and is connected to the end frame portions 26 at a position essentially midway between the sides 14 and 16 of the base 12. The cross frame portion 32 includes upright struts 34 connected at their lower ends to the base 12 and at their upper ends to the top members 30. Horizontally-extending load supporting members in the form of rails 36 are mounted on the struts 34 in vertically spaced-apart positions. The rails 36 extend across the entire length of the cross frame portions 32 and each consists of an outwardly and upwardly extending hook portion 38 which allows containers (not shown) having associated outwardly and downwardly extending hook portions to be slideably mounted on the rails 36. The provision of the open end framework portions 26 enables the containers on the rails 36 to be slideably moved lengthwise of the base 12 and through the end portions 26. The containers also can be removed by moving them sideways across the base 12 at a position between the end frame portions 26. It clearly can be seen that the open framework construction allows access to the goods on the pallet 10 to be made from any side or end of the pallet 10. Each rail 36 also includes a bottom cross-portion 40 that is spaced slightly below the hook portion 38. The bottom cross-portion 40 for each rail 36 acts as a backing support against which the portion of the container below the hook portion 38 rests when it is hung upon a rail 36 to keep the container in an upright position. Each rail 36 has opposed hook portions 38 so that the containers can be hung on both sides of the cross frame portion 32.

The legs 22 are located in substantial vertical alignment with the top members 30 which enables the pallet 10 to be stacked on another like pallet as is shown in FIG. 2. Each leg 22 includes a ground-engaging portion 42 that is positioned inwardly of the top frame member 30 on the subjacent pallet 10. The ground-engaging portion 42 supports the pallet 10 when it is located on a flat surface. Positioned outwardly of the ground-engaging portion 42 is a concave portion 44 which extends transversely of the base 12 and which is located outside of and above the ground-engaging portion 42. The top member 30 of the subjacent pallet 10 is received in the concave portions 44 of the legs 22, and cooperates therewith to restrict lengthwise relative movement between a pair of stacked pallets 10. Also, by virtue of the ground-engaging portion being located inwardly of the top member 30 lengthwise relative movement between the stacked pallets 10 is further inhibited. Thus, the legs 22 and the top members 30 cooperate to form locating means to inhibit horizontal relative movement between a pair of stacked pallets 10.

The locating means further includes a recess 46 formed in each supporting leg 22 which is defined by upwardly-converging surfaces 48 in the leg 22. Projecting members 50 are mounted on the top members 30 in spaced-apart relationship so that each projecting member 50 is received into the recess of an associated leg 22 when the pallet 10 is lowered onto the next pallet 10. Each projecting member 50 has an outwardly-facing surface 52 and an inwardly-facing surface 54 which converges with the surface 52 in directions upwardly of the top member 30. The inwardly-facing surface 54 is generally upright and it is essentially flush with the inner boundary of the top member 30. By virtue of the converging construction of the projecting members 50 and their associated recesses 46, the locating means functions to direct the pair of stacked pallets 10 to a predetermined horizontal orientation as they are stacked. Accordingly, the pallets are stacked one upon another in general alignment which insures the stability of the stack of pallets 10.

A modified embodiment of the pallet of the present invention is indicated at 100 in FIG. 4. The pallet 100 includes a metallic rectangular base 112 having sides 114 and 116 and ends 118 and 120. Corner-supporting legs 122 extend downwardly from the base 112 to provide a clearance below the base 112. An upright frame 124 is mounted on the base 112 and includes opposite open end frame portions 126 each having upright end members 128 and a generally horizontal top member 130 located at the upper end of the end members 128. A cross frame portion 132 extends between and is connected to the end portions 126 near the side 116 of the base 112. Upward struts 134 are mounted to the pallet at the end portions 126 and are further attached to the near end members 128 by cross struts 140. The above-described structure of the pallet 100 is identical to the structure of the pallet 10 except that the cross frame portion 132 is nearer the side 116 whereas the cross frame portion 132 is located midway between the sides 14 and 16 of the base 12.

The cross frame portion 132 further includes an upright intermediate strut 138 that is connected at its lower end at the base 112 and at its upper end to an auxiliary cross top member 135 that extends between and is connected to the upright struts 134.

Hanging strip members 140 are secured to the outside surface of the upright struts 134 on both ends 118 and 120 of the pallet 100 and are formed having a plurality of vertically-spaced openings 142 facing angularly away from the cross frame portion 132. An intermediate hanging strip 144 is mounted on the intermediate strut 138 and includes inwardly-facing openings 148 and 146 that face angularly away from the cross frame portion 132.

Vertically-spaced load supporting members 152 in the form of shelves 154 that extend substantially the entire length of the cross frame portion 132 and a display shelf 156 which extends only partially across the entire length of the cross frame portion 132 are detachably mounted on the cross frame portion 132. Each shelf 154 includes spaced-apart arms 158 on which brackets 159 are mounted, each bracket 159 including T-shaped teeth 160 vertically spaced-apart distances equal to the distances between adjacent openings 142 in the hanging strips 140. The teeth 160 are oriented so that they are essentially normal to the openings 142. Accordingly, as can be seen in FIG. 6, the teeth 160 project inwardly into the openings 162 to mount the shelves 154 on the cross frame portion 132. The display shelf 156 is of a length sufficient so that one mounting bracket mount on the hanger strip 140 (FIG. 8), identical to the strip shown in FIG. 5, and to the intermediate hanging strip 144 (FIG. 7).

When all of the shelves 152 are removed from the pallet 100, the pallet 100 can serve to carry large objects. The frame 124 serves as a bracing structure to which these large objects can be secured such as by straps to prevent them from tipping off the pallet 100 during its movement from place to place. The open end portions 126 enable parts or equipment supported on the shelves 152 to be removed by lengthwise movement thereof through the end portion 126. Similarly, any objects or parts can be removed in the conventional manner simply by moving them crosswise off the pallet 100. It can be seen that a large number of shelving variations are possible with the pallet 100. For instance, only shelves having a length equal to the display shelf 156 can be mounted on the cross frame portion 132 in vertical alignment with each other. This mounting leaves an open space next to the shelves 156 to accommodate taller objects.

The pallet 100 includes locating means in the form of projecting members 162 and recesses in the supporting legs 122 that are identical in construction and function as the locating means described in connection with the pallet 10. Accordingly, further description of the locating means in connection with the pallet 100 will not be made.

From the above description, it can be seen that an improved material handling pallet is disclosed providing an open framework construction which supports and anchors objects and equipment on the pallet enabling access to be gained through the open framework construction from all sides of the pallet 10. The locating means serves an important guiding function; that is, when one pallet is lowered onto another pallet, the projecting members on the horizontal members of the lower pallet engage the recesses in the legs of the upper pallet to align the pallets. If the pallets are slightly out of alignment, the tapered construction of the projecting members and the recesses will co-act to guide the pallets into alignment as the upper pallet is lowered on another pallet so that the proper horizontal orientation is assured when the pallets are stacked upon each other.

Also, the base of the pallet is strong so that only the corner legs are necessary to support the loaded pallet. The pallet can thus be stored in a rack consisting only of parallel rails spaced a distance equivalent to the distance between the corner legs. Otherwise, if the base was of inadequate strength, centrally-located legs would have to be employed reducing the possible locations at which the pallet could be stored. The pallet of this invention is thus versatile and durable in order to accommodate a variety of transportable goods.

What is claimed is:

1. A material handling pallet comprising a rectangular base having sides and ends, a plurality of spaced-apart supporting legs connected to and extending downwardly from said base, said legs each having a ground-engaging portion and cooperatively effecting a clearance below said base for receiving pallet-lifting means, an upright frame mounted on said base and consisting of a pair of open framework end portions positioned at opposite ends of said base and a cross frame portion extending lengthwise of said pallet at a position between and connected to said end portions, vertically-spaced horizontal load supporting members on said cross frame portion extending lengthwise of said pallet for supporting objects which are removable from said load-supporting members by movement thereof lengthwise of said cross frame portion through said open framework end portions or sideways of said cross frame portion across one side of said pallet at a position between said frame end portions, said frame terminating at the upper end thereof in frame members which extend transversely of said base and which are in substantial vertical alignment with said supporting legs enabling said pallet to be stacked upon another like pallet, each of said legs having a receiver portion positioned adjacent to and above said ground-engaging portion, said receiver portion being positionable on a transversely extending frame member of another pallet so that said leg is lowered into a position in which it is in horizontal interfering relationship with said frame member to cooperate therewith to restrain relative lengthwise movement between a stacked pair of pallets, a plurality of projecting members on said frame members extending upwardly therefrom, and a recess in each of said legs located above said ground engaging portion and operable to receive an associated one of the projecting members on the frame members of a lower pallet to restrain relative horizontal movement between the stacked pair of pallets.

2. The pallet according to claim 1, wherein each of said end frame portions comprises a pair of spaced-apart upright end members and a generally horizontally-disposed top member extending between and connected to said upright end members at the upper ends thereof, said top member forming an upper end frame member.

3. The pallet according to claim 1, wherein said horizontal load-supporting members comprise rail members extending substantially the full length of said cross frame portion for slidably supporting a plurality of containers or the like for movement lengthwise of said cross frame portion through said end portions.

4. The pallet according to claim 3, wherein said rail members are disposed on opposite sides of said cross frame portion.

5. The pallet according to claim 4, wherein said cross frame portion is positioned essentially midway between said sides of said base.

6. The pallet according to claim 1, wherein selected ones of said load-supporting members extend substantially the entire length of said cross frame portion and other selected ones of said load-supporting members extend partially the entire length of said cross frame portion.

7. The pallet according to claim 1, further including coacting hanging means on said horizontal load-supporting members and on said cross frame portion detachably mounting said load-supporting members on said cross frame portion.

8. The pallet according to claim 7, wherein said coacting hanging means comprises means forming a plurality of vertically-spaced openings on said cross frame portion, and outwardly-projecting finger members mounted on said load-supporting members and received in said openings at a selected vertical position of said load-supporting member on said cross frame portion.

9. The pallet according to claim 1, wherein each of said projecting members has tapered surfaces converging upwardly from said frame member, each of said recesses being defined by surfaces converging upwardly into said supporting leg and cooperating with said projecting member to restrain relative horizontal movement between said stacked pallets.

10. The pallet according to claim 9, wherein said projecting member has a generally-upright, inwardly-facing surface substantially aligned with the inner edge of its associated frame member.

11. A material handling pallet comprising a rectangular base having sides and ends, a plurality of spaced-apart supporting legs having ground engaging portions and being connected to and extending downwardly from said base effecting a clearance therebelow for receiving pallet-lifting means, an upright frame mounted on said base and consisting of a pair of open framework end portions positioned at opposite ends of said base and a cross frame portion extending lengthwise of said pallet at a position between and connected to said end portions, load-supporting means on said cross frame portion for supporting objects thereon, said frame terminating at the upper end thereof in frame members which extend transversely of said base and which are in substantial alignment with said legs enabling said pallet to be stacked upon another like pallet, and locating means on said frame members and on said supporting legs comprising projecting members on said frame members extending upwardly therefrom, and a recess formed in each of said supporting legs at a position above the ground engaging portions thereof, said projecting members being received in the recess of an associated one of said supporting legs and cooperating therewith to restrain relative horizontal movement between said stacked pallets.

12. A material handling pallet comprising a rectangular base having sides and ends with depending legs extending downwardly below said base, an upright frame mounted on said base and consisting of a pair of open framework end portions positioned at opposite ends of said base and a cross frame portion extending lengthwise of said pallet at a position between and connected to said end portions, said legs and framework end portions being aligned so that a plurality of said pallets can be stacked one upon another, vertically-spaced horizontal load-supporting members on said cross frame portion extending lengthwise of said pallet, said load-supporting members being adapted to support objects which are removable from said load-supporting members by slidable movement thereof on said load-supporting members lengthwise of said cross frame portion through said open framework end portions or by movement sideways of said cross frame portion across one side of said pallet at positions between said frame end portions, each of said legs having a ground-engaging portion and a receiver portion above said ground-engaging portion for receiving a framework end portion of another pallet so that said legs are lowered into positions in which they are in horizontal interfering relationship with said framework end portions to restrain lengthwise movement between a pair of stacked pallets, and cooperating projection and recess means on said framework end portions and on said legs cooperating to restrain horizontal movement between a pair of stacked pallets.

13. The pallet according to claim 12, wherein each of said load-supporting members comprises a rail extending across the entire length of said cross frame portion, said rail including an outwardly and upwardly extending hook portion.

14. A material handling pallet comprising a rectangular base having sides and ends and forming a low platform on which materials can be placed, an upright frame mounted on said base and comprising a pair of open framework end portions positioned at opposite ends of said base and a cross frame portion extending lengthwise of said pallet between and connected to said end portions, said cross frame portion including a plurality of upright frame members spaced apart longitudinally of said base between said ends, one frame member positioned at each end of said pallet and an intermediate frame member positioned between said end upright frame members, said upright frame members having mounting means for supporting a plurality of load supporting members in a selected arrangement of vertically spaced apart positions, said mounting means on said end frame members being operable to support load-supporting members that extend essentially the entire length of the pallet, and said mounting means on a selected one of said end frame members and said intermediate frame member being operable to support load supporting members that extend essentially the entire length between said selected end frame member and said intermediate frame member whereby said selected arrangement of the load supporting members and said base are cooperable to support materials of different sizes and shapes.

* * * * *